US008403522B2

(12) United States Patent
Chang

(10) Patent No.: US 8,403,522 B2
(45) Date of Patent: Mar. 26, 2013

(54) LED LAMP

(75) Inventor: Jen-Tsorng Chang, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 498 days.

(21) Appl. No.: 12/723,704

(22) Filed: Mar. 15, 2010

(65) Prior Publication Data

US 2011/0038144 A1 Feb. 17, 2011

(51) Int. Cl.
*F21V 1/00* (2006.01)
*F21V 5/00* (2006.01)

(52) U.S. Cl. ..... 362/217.02; 362/217.03; 362/217.04; 362/217.05; 362/217.06; 362/217.07; 362/217.08; 362/217.09

(58) Field of Classification Search . 362/217.02–217.09
See application file for complete search history.

(56) References Cited

U.S. PATENT DOCUMENTS

| | | | | |
|---|---|---|---|---|
| 7,918,580 | B2 * | 4/2011 | Liu | 362/218 |
| 2007/0070621 | A1 * | 3/2007 | Rivas et al. | 362/217 |
| 2007/0153548 | A1 * | 7/2007 | Hamada et al. | 362/615 |
| 2009/0161359 | A1 * | 6/2009 | Siemiet et al. | 362/235 |

* cited by examiner

*Primary Examiner* — William Carter
(74) *Attorney, Agent, or Firm* — Altis Law Group, Inc.

(57) ABSTRACT

An exemplary LED lamp includes a heat dissipation module, a light source mounted on the heat dissipation module, a cover engaging the heat dissipation module and covering the light source, a reflective layer mounted on the cover, and two connectors secured at two corresponding ends of the cover and the heat dissipation module. The cover has an inner surface and a convex outer surface. The inner surface includes a first concave surface and two second concave surfaces at lateral sides of the first concave surface. The second concave surfaces face the LEDs and configured as light incident surfaces; light emitted by the LEDs incidents onto the second concave surfaces and travels through the cover to an outside for lightening. A part of the light is reflected by the reflective layer before travelling to the outside.

13 Claims, 3 Drawing Sheets

LED LAMP

BACKGROUND

1. Technical Field

The present disclosure generally relates to LED (light emitting diode) lamps and, more particularly, to an LED lamp with a great heat dissipating capability and even distribution of light emission.

2. Discussion of Related Art

Light emitting diodes (LEDs) are one kind of semiconductor element. Nowadays, LEDs are extensively used as light sources for illuminating apparatuses, due to their high luminous efficiency, low power consumption and long work life.

An LED lamp requires a number of LEDs, and most of the LEDs are driven at the same time, which results in a quick rise in temperature of the LED lamp. Since generally the LED lamps do not have heat dissipation devices with good heat dissipating efficiencies, operation of the conventional LED lamp has a problem of instability because of the rapid increase of heat. Especially, an LED light tube which has a shell made of plastic or glass, which degrades the heat dissipation efficiency. If the LED lamp is used in a state of high temperature for a long time, the life thereof is dramatically shortened. Furthermore, the conventional illumination apparatus incorporating LEDs generally generates a butterfly-type light field or has a radiation angle about 120 degrees. The intensity of light emitted by the LEDs is unevenly distributed; the light intensity dramatically decreases when the radiation angle exceeds 120 degrees.

Therefore, what is needed is an LED lamp which can overcome the above described shortcomings.

DETAILED DESCRIPTION OF EMBODIMENTS

Reference will now be made to the drawings to describe various embodiments of the present LED lamp in detail.

Figure 1:
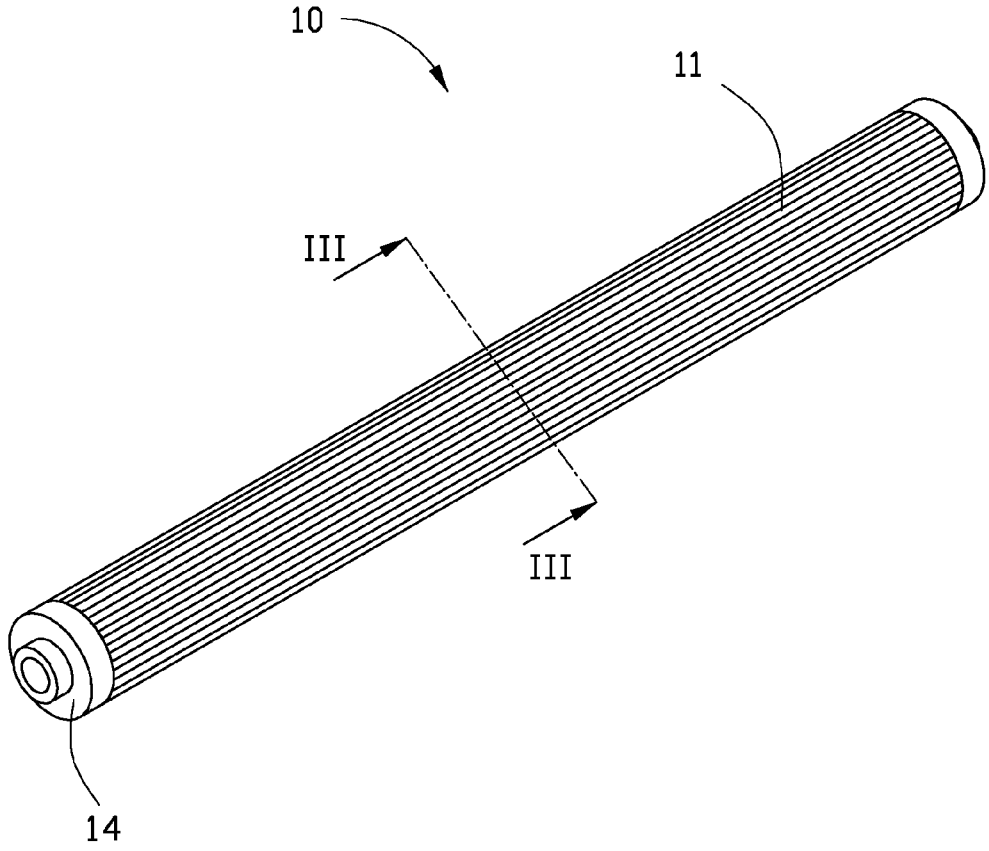
FIG. 1 is an assembled view of an LED lamp in accordance with an embodiment of the present disclosure.
Figure 2:
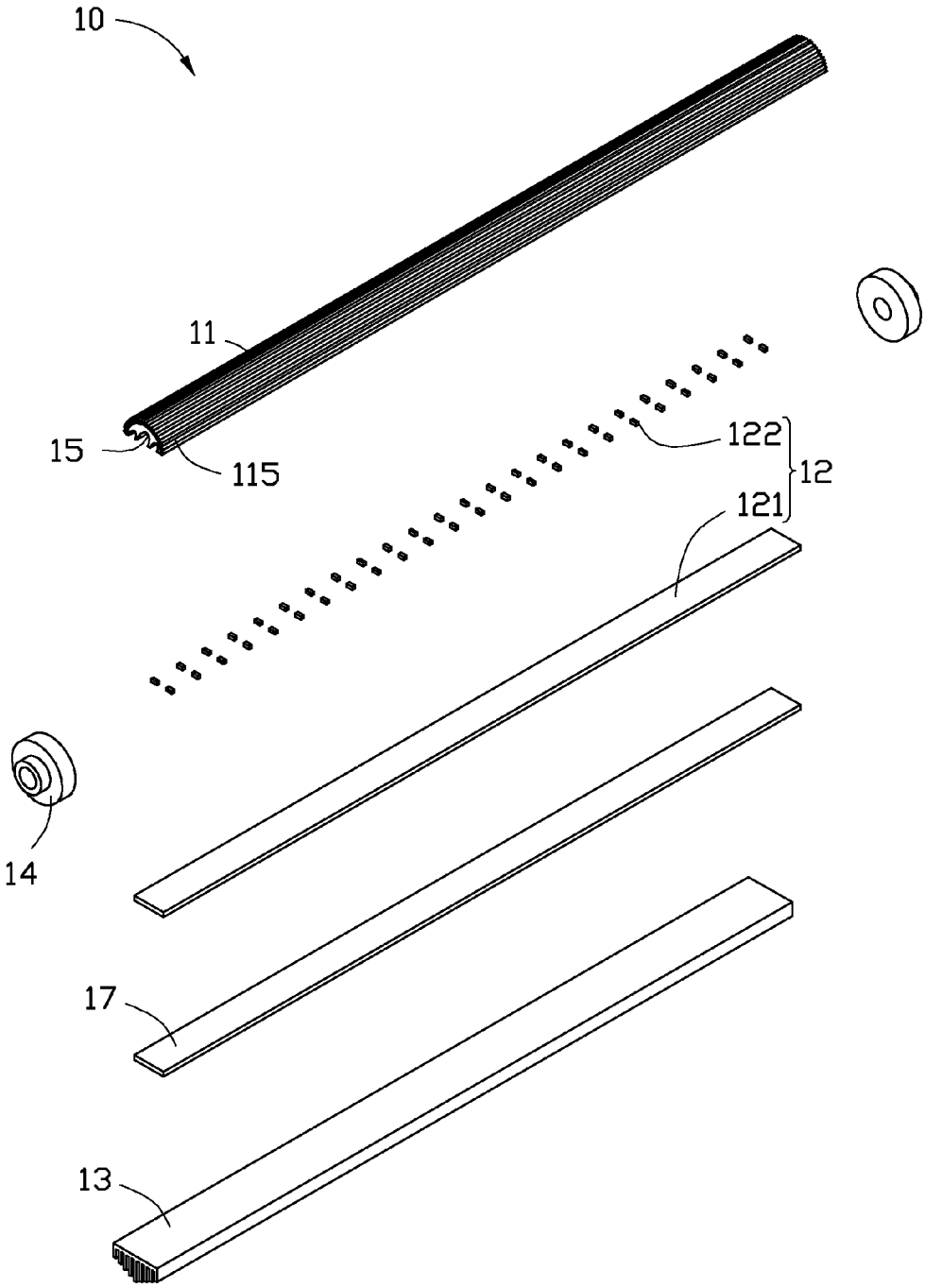
FIG. 2 is an exploded view of the LED lamp of FIG. 1.
Figure 3:
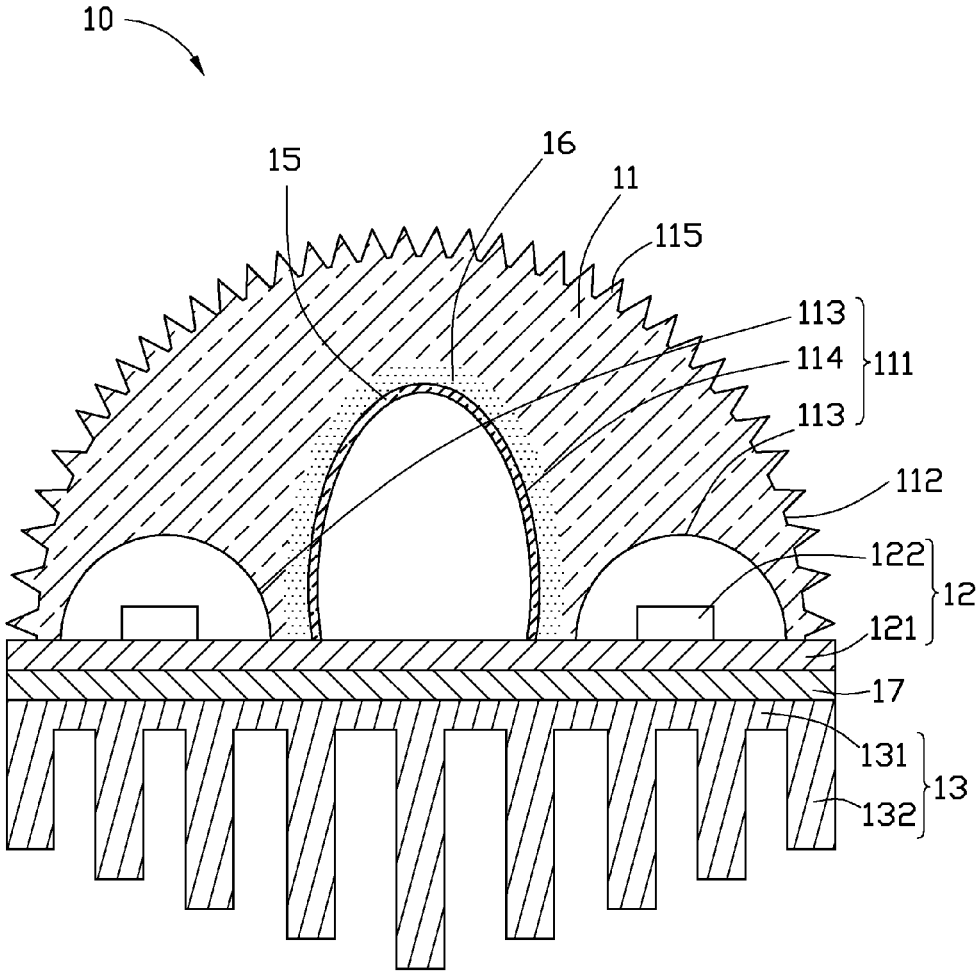
FIG. 3 is a cross-sectional view of the LED lamp of FIG. 1, taken along line thereof.

Referring to FIGS. 1-3, an LED lamp 10, in accordance with an embodiment of the present disclosure, includes a heat dissipation module 13, a light source 12 mounted on the heat dissipation module 13, an elongated light transmitting cover 11 engaging the heat dissipation module 13 and covering the light source 12, a reflective layer 15 coated on the cover 11, and two connectors 14 secured at the two opposite ends of the cover 11 and the heat dissipation module 13.

The heat dissipation module 13 includes a flat base 131 and a number of fins 132 extending from the base 131 in array and spaced from each other. In this embodiment, the heat dissipation module 13 is integrally extruded by a metal block, for example, an aluminum block. Heights of the fins 132 gradually decrease from a central one of the fins 132 toward lateral fins 132, whereby upper free ends of the fins 132 cooperatively define a convex surface.

The light source 12 is mounted on the base 131 of the heat dissipation module 13. The light source 12 includes a substrate 121 and a number of LEDs 122 evenly mounted in two groups as two lines on the substrate 121 along a lengthwise direction of the substrate 121. Each LED 122 is mounted in a thermally conductive relationship with the substrate 121.

When the light source 12 is mounted on the base 131, a layer of thermal interface material (TIM) 17 may be applied between the substrate 121 and base 131 to eliminate an air interstice therebetween, thereby enhancing a heat conduction efficiency between the light source 12 and the base 131 of the heat dissipation module 13.

The cover 11 has a semi-cylindrical shape and includes an inner surface 111 and a convex surface 112. The inner surface 111 faces the LEDs 122. The convex surface 112 is semi-cylindrical shape. In the present embodiment, the inner surface 111 includes a first concave surface 114 and two second concave surfaces 113 at the lateral sides of the first concave surface 114. The first concave surface 114 and the second concave surfaces 113 extend along a lengthwise direction of the cover 11, which is coincident with an axial direction of the LED lamp 10. The first concave surface 114 has a semi-elliptical shape. The second concave surfaces 113 each have a semi-cylindrical shape. The second concave surfaces 113 each face a corresponding group of the LEDs 122 and are configured as light incident surfaces. Light emitted from the LEDs 122 incidents onto the second concave surfaces 113 and travels through the cover 11 to an outside of the LED lamp 10 for lightening. The cover 11 is transparent, such as glass, resin, etc. In another embodiment, the first concave surface 114 can have semi-cylindrical shape, and the second concave surfaces 113 each can have a semi-elliptical shape.

In the present embodiment, heights of the second concave surfaces 113 are the same as each other, which are less than a height of the first concave surface 114. A number of particles 16 are distributed in the cover 11 and near the first concave surface 114. Each of the particles 16 is round, and has an average diameter in micro-scale. The particles 16 are made of metal, such as silver particles, and configured for distributing the light emitted from the light source 12. In an alternative embodiment, the heights of the second concave surfaces 113 can be equal to that of the first concave surface 114.

A number of elongated micro-structures 115 extend radially and outwardly from the convex surface 112 of the cover 11 along the lengthwise direction of the cover 11. The micro-structures 115 have a uniform extending height. Upper free ends of the micro-structures 115 cooperatively define an imaginary semicircle. In the present embodiment, the cross-section of each of the micro-structures 115 is an isosceles serration. The density of the micro-structures 115 decreases from a center of the cover 11 toward lateral sides of the cover 11. The micro-structures 115 are configured for diffusing light emitted from the light source 12.

The reflective layer 15 is coated on the first concave surface 114 and configured for reflecting light emitted from the light source 12. Usually, the reflective layer 15 is formed on the first concave surface 114 by sputtering.

The connectors 14 are secured at the two opposite ends of the cover 11 and the heat dissipation module 12. The connectors 14 are provided for connecting with an external power source via two sockets (not shown) of a lamp holder (not shown) whereby the LEDs 122 can obtain the required electrical power for generating light. The connectors 14 are electrically connected with the LEDs 122.

A part of light emitted from the LEDs 122 can directly pass through the cover 11 for lighting. Other part of light emitted from the LEDs 122 is reflected by the reflective layer 15 and distributed by the particles 16 to different directions; therefore, the light emission of the illuminating device 10 can be substantially evenly distributed. Heat generated by LEDs 122 is transferred to the fins 132 via the base 131, and dissipated to the environmental air; therefore, a heat dissipating capability, and the brightness, lifespan, and reliability of the LED lamp 10 will be improved.

It is to be further understood that even though numerous characteristics and advantages have been set forth in the foregoing description of embodiments, together with details of the structures and functions of the embodiments, the disclosure is illustrative only; and that changes may be made in detail, especially in matters of shape, size, and arrangement of parts within the principles of the disclosure to the full extent indicated by the broad general meaning of the terms in which the appended claims are expressed.

What is claimed is:

1. A light emitting diode (LED) lamp comprising:

a heat dissipation module;

a light source mounted on the heat dissipation module, the light source comprising a substrate and a number of LEDs arranged in a plurality of groups on the substrate along a lengthwise direction of the substrate;

a cover covering the LEDs, the cover comprising an inner surface and a convex outer surface, the inner surface comprising a first concave surface and a plurality of second concave surfaces at lateral sides of the first concave surface, the first concave surface and the second concave surfaces extending along a lengthwise direction of the cover, each of the second concave surfaces facing a corresponding group of the LEDs, and configured as a light incident surface, wherein a height of each of the second concave surfaces is equal to or less than that of the first concave surface; and a reflective layer coated on the first concave surface, wherein light generated by the LEDs has a part transmitting outwardly directly out of the cover and another part reflected by the reflective layer to transmit out of the cover.

2. The LED lamp of claim 1 further comprising a number of micro-structures arranged on the convex outer surface of the cover.

3. The LED lamp of claim 2, wherein the micro-structures extend along the lengthwise direction of the cover.

4. The LED lamp of claim 2, wherein a cross-section of each of the micro-structures is an isosceles serration.

5. The LED lamp of claim 2, wherein a density of the micro-structures decreases from a center of the cover toward lateral sides of the cover.

6. The LED lamp of claim 1, wherein a number of particles are distributed in the cover and near the first concave surface, the particles being configured for distributing the light emitted from the LEDs.

7. The LED lamp of claim 1, wherein the heat dissipation module comprises a base and a number of fins mounted on the base, a height of the fins gradually decreasing from a central one of the fins toward lateral ones of the fins.

8. The LED lamp of claim 1, wherein the first concave surface and the second concave surfaces each have one of a semi-cylindrical shape and a semi-elliptical shape.

9. The LED lamp of claim 1, wherein heights of the second concave surfaces are the same as each other.

10. The LED lamp of claim 1 further comprising a layer of thermal interface material applied between the heat dissipation module and the light source.

11. The LED lamp of claim 1 further comprising two connectors secured at the two ends of the cover and the heat dissipation module and configured for receiving external electrical power.

12. A light emitting diode (LED) lamp comprising:

a light source comprising a number of LEDs;

a cover covering the light source, the cover comprising an inner surface and a convex outer surface, the inner surface comprising a first concave surface and two second concave surfaces at lateral sides of the first concave surface, the first concave surface and the second concave surfaces extending along a lengthwise direction of the cover, the second concave surfaces facing the LEDs, and configured as light incident surfaces, wherein a height of each of the second concave surfaces is equal to or less than that of the first concave surface; and a reflective layer coated on the first concave surface and configured for reflecting light emitted from the LEDs to an outside of the LED lamp for lightening.

13. The LED lamp of claim 12 further comprising a number of micro-structures arranged on the convex outer surface of the cover.

* * * * *